US007461495B2

(12) United States Patent
Mills

(10) Patent No.: US 7,461,495 B2
(45) Date of Patent: Dec. 9, 2008

(54) PACKAGING CONTROL WITH TRANSLATION OF COMMAND PROTOCOLS

(75) Inventor: Paul Mills, Nottingham (GB)

(73) Assignee: Markem Technologies Limited (GB)

( * ) Notice: Subject to any disclaimer, the term of this patent is extended or adjusted under 35 U.S.C. 154(b) by 1287 days.

(21) Appl. No.: 09/728,395

(22) Filed: Dec. 1, 2000

(65) Prior Publication Data

US 2001/0005968 A1 Jul. 5, 2001

(30) Foreign Application Priority Data

Dec. 4, 1999 (GB) ..... 9928595.9

(51) Int. Cl.
*B65B 61/26* (2006.01)
*B65B 57/00* (2006.01)

(52) U.S. Cl. ..... 53/131.2; 53/501; 53/502; 53/504; 53/52

(58) Field of Classification Search ..... 53/52, 53/501, 502, 504, 147, 131.2
See application file for complete search history.

(56) References Cited

U.S. PATENT DOCUMENTS

| | | | | |
|---|---|---|---|---|
| 3,940,830 | A | 3/1976 | Anderson et al. | |
| 4,571,925 | A | 2/1986 | Adams | |
| 4,583,345 | A * | 4/1986 | Hirosaki et al. | 53/131.2 |
| 5,406,770 | A | 4/1995 | Fikacek | |

(Continued)

FOREIGN PATENT DOCUMENTS

WO WO99/13418 3/1999

OTHER PUBLICATIONS

Search Report.

(Continued)

*Primary Examiner*—Rinaldi I. Rada
*Assistant Examiner*—John Paradiso
(74) *Attorney, Agent, or Firm*—Fish & Richardson P.C.

(57) ABSTRACT

A packaging system for packaging a plurality of individual articles into packs and for collecting together a plurality of packs into a packaged unit, the system including a first part where the individual articles are marked utilising a first marking apparatus, a second part where the packs are marked utilising a second marking apparatus, and a third part where the packaged unit is marked utilising a third marking apparatus, and the first part including a packing apparatus for packing the articles into packs and first conveyor for moving the packs from the first part to the second part, and the second part including second conveyor for conveying the packs from the second to the third system part, and the third part including a packaging apparatus which collects the plurality of packs into a packaging unit, wherein each of the first, second and third marking apparatus, and the packaging apparatus which collects the plurality of packs into a packaged unit are connected to a data bus by respective connectors, there being a controller also connected to the data bus, the controller sending appropriately addressed data bus commands on the data bus to each of the connected components, the data bus commands all using a common computer protocol, and each of the connections of the connected components being capable of translating data bus commands appropriate to that component into a command protocol which is read by the connected component which responds by performing a productive function, whereby the controller means is able to control each of the connected components independent of command protocols recognised by the connected components.

13 Claims, 1 Drawing Sheet

U.S. PATENT DOCUMENTS

| | | | | |
|---|---|---|---|---|
| 5,661,948 | A | 9/1997 | Odenthal | |
| 5,884,451 | A | 3/1999 | Kano et al. | |
| 6,122,895 | A * | 9/2000 | Schubert | 53/240 |
| 6,155,025 | A * | 12/2000 | Komiya et al. | 53/147 |
| 6,314,706 | B1 * | 11/2001 | Araki et al. | 53/451 |
| 6,363,687 | B1 * | 4/2002 | Luciano et al. | 53/131.2 |

OTHER PUBLICATIONS

Search Report Under Section 17 from the British Patent Office for Appln. No. GB 9928595.9 dated Mar. 7, 2000.

* cited by examiner

I
II
III
9
9a
9
16
16a
40
44
45
46
50
51
52
11
11a
12
14
14a
15
15a
13
13a
18a
18
17
10
24a
24
21
21a
20
22
22a
8
8a
7
7a
33
33a
34
30
30a
31
60

PACKAGING CONTROL WITH TRANSLATION OF COMMAND PROTOCOLS

RELATED APPLICATION

This application claims priority to United Kingdom Patent Application No. 9928595.9 filed Dec. 4, 1999, assigned to Markem Technologies Limited, the Assignee of the present invention, the entire contents of which are incorporated herein by reference.

BACKGROUND OF THE INVENTION

This invention relates to a packaging system for packaging a plurality of articles into packs and for collecting together a plurality of packs into a packaged unit.

SUMMARY OF THE PRIOR ART

Packaging systems are known which include a first part where the individual articles are packed into a pack after having been marked utilising a first marking means such as a continuous ink jet printer. Such a packaging system typically has a second part to which the packs may be conveyed and where the packs themselves are marked utilising a second marking means such as a laser printer which may mark by oblation. The thus marked packs are conveyed to a third part where the packs are collected together into a packaged unit which is marked utilising a third marking means such as a label printer and the labels are applied to the packaged unit.

The first part of the system may include a packing means for packing the articles into packs, with there being a first conveying means for moving the individual articles in their packs from the first part to the second part. The second part may include second conveying means for conveying the packs from the second to the third system part, and the third system part may include a palletiser or the like, for collecting the packaged units onto a pallet for ease of handling. Labels may be applied to a wrapping applied to the collected packs of the packaged unit.

It will be appreciated that considerable co-ordination is required not only between the first, second and third system parts, but additionally for the individual components of the packaging system i.e. the first, second and third marking means, and the packing means, palletiser and first and second conveying means where all these are provided.

Conventionally, the palletiser has been controlled by a programmable logic controller or like control, and this control has largely governed the packaging system speed, but each of the other components have been controlled individually.

It is not usual that the palletiser and all other components of the system are provided by the same manufacturer. Indeed even components provided by the same manufacturer may not all be compatible with each other from a control point of view. Where all the marking means are provided by a common manufacturer, these may all be controlled by a common control means, but a single manufacturer may not provide a full range of different marking means particularly suited for use in the different parts of the packaging system.

Accordingly hithertofore, a fully integrated packaging system of the kind with which the present invention is concerned has not been capable of being provided.

SUMMARY OF THE INVENTION

According to one aspect of the invention we provide a packaging system for packaging a plurality of individual articles into packs and for collecting together a plurality of packs into a packaged unit, the system including a first part where the individual articles are marked utilising a first marking means, a second part where the packs are marked utilising a second marking means, and a third part where the packaged unit is marked utilising a third marking means, and the first part including packing means for packing the articles into packs and first conveying means for moving the packs from the first part to the second part, and the second part including second conveying means for conveying the packs from the second to the third system part, and the third part including means to collect the plurality of packs into a packaging unit, characterised in that each of the first, second and third marking means, and the means for collecting the plurality of packs into a packaged unit are connected to a data bus by respective connecting means, there being a control means also connected to the data bus, the control means sending appropriately addressed data bus commands on the data bus to each of the connected components, the data bus commands all using a common computer protocol, and each of the connecting means of the connected components including means to translate data bus commands appropriate to that component into a command protocol which is read by the connected component which responds by performing a productive function, whereby the control means is able to control each of the connected components independent of command protocols recognised by the connected components.

Thus utilising the present invention, the system may be controlled irrespective of different command protocols recognised by the connected components due to e.g. the connected components emanating from different manufacturers, or otherwise being non-compatible from a control point of view.

If desired the first and/or second conveying means may also be connected to the data bus via suitable connecting means which may translate appropriately addressed data bus commands into command signals to operate the conveyor(s), and thus the conveyor means too may be controlled by the control means, irrespective of manufacturer.

Each of the first, second and third marking means may include respectively one or more of a continuous ink jet printer, a laser printer, a thermal transfer printer and a label printer for examples only.

The first part of the packaging system may include means to weigh and/or size and/or count elements and/or otherwise analyse the articles so that information marked on the individual articles by the first marking means is dependent upon the analysis.

The third part means to collect the plurality of packs into a packaging unit may include a palletiser whereby the packaged unit is a collection of packs on a pallet. The palletiser may include means to wrap the collected articles in a wrapping and means to apply labels printed by the third marking means to the wrapping.

The data bus may be provided by a connection cable so that the connected components are all physically connected together. For example the data bus may include an RS485 or RS422 or Ethernet standard cable. Alternatively the data bus may be virtual with each of the connected components receiving radio, infra red, microwave or other transmitted data bus commands and being adapted to respond to and translate data bus commands appropriate to that component into command protocols.

In each case the control means may issue data bus commands using HTTP or TCP/IP, ITX FTP protocol for examples only, so that there is no need to translate command protocols into signals using protocols specific to connected components prior to the sending of command protocols to the data bus.

The control means may however include a database of connected components so that command protocols appropriate to the functionality of the connected components are issued.

BRIEF DESCRIPTION OF THE DRAWINGS

The invention will now be described with reference to the accompanying drawings in which.

DESCRIPTION OF THE PREFERRED EMBODIMENTS

Figure 1:
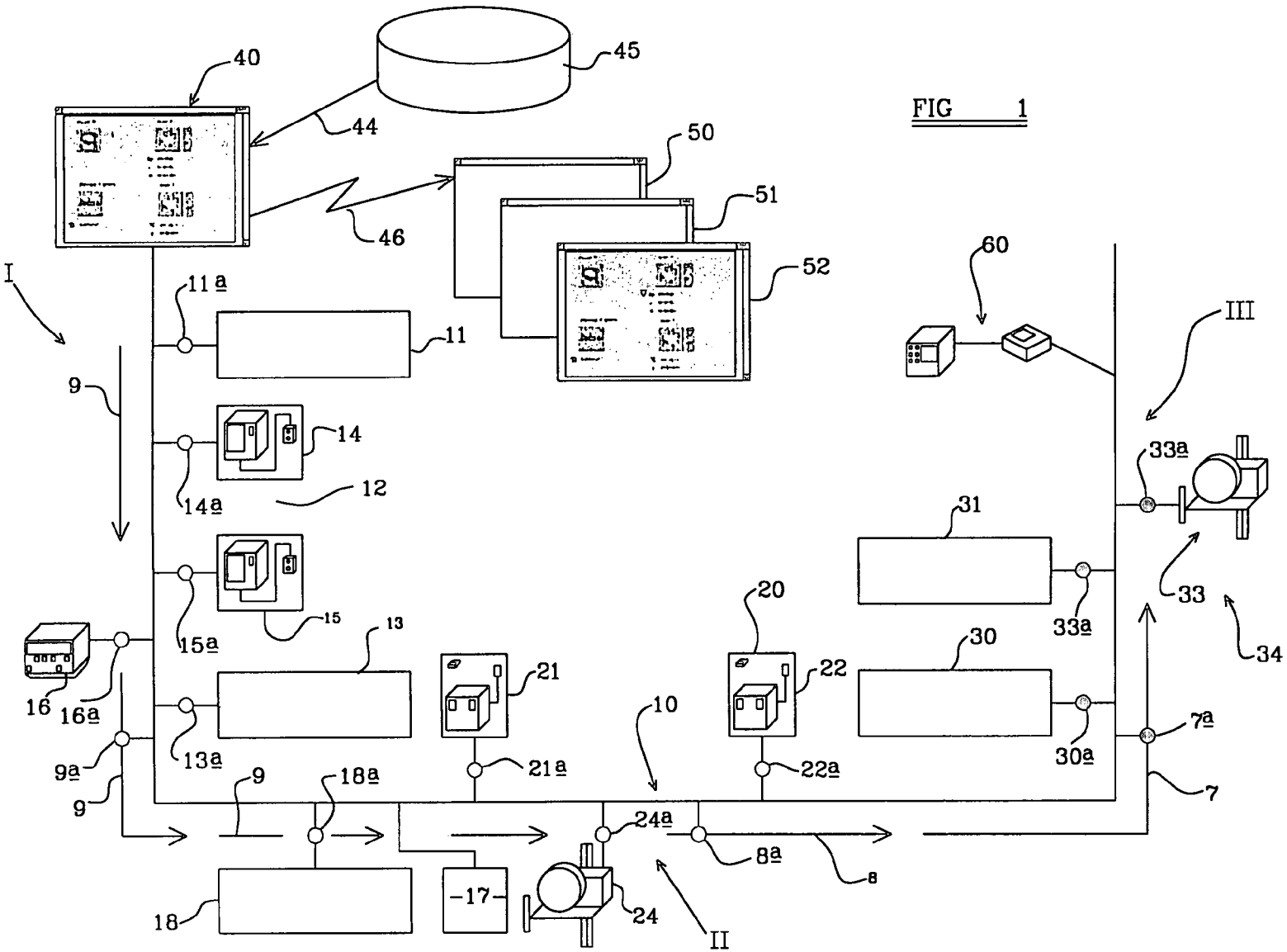
FIG. 1 is a diagrammatic illustration of a packaging system in accordance with the invention.

Referring to the drawing, a packaging system of for example a potato crisp factory is shown, which packaging system includes a first part I, a second part II and a third part III.

The first part I includes various components connected to a data bus 10 as follows. First there is an article weigh station 11 for weighing articles into individual packets to ensure that there is at least a minimum weight of crisps in each packet, and that the weights of the individual packets fall within a predetermined range. The articles (packets) are conveyed by a first conveying means 9 to a first printing station 12 where a first marking means are provided. For illustrative purposes, at the first printing station 12 there are shown a pair of continuous ink jet type printers 14, 15 and a thermal transfer type printer 16 each of which is capable of printing information directly on plasticised crisp packets. Each of the printers 14-16 prints information onto individual crisp packets, such as a lot number and/or sell-by date or the like. Such printers are known as primary pack coders, because the packets in which the crisps are contained are termed primary packs.

After marking at the first printing station 12, the packs may be conveyed by the first conveying means 9 to a check weigh station 13 where the weights of the individual packets are checked, and then past a metal detector 18 which checks to ensure that none of the packets are contaminated with metal, e.g. metals particles from the crisp production line upstream.

Individual packets of crisps are then packaged into packs e.g. cardboard cartons, by an automated packing machine (not shown) and the packs are then conveyed to the second part II of the packaging system.

The second part II of the packaging system includes a second printing station 20 at which second marking means are provided for marking the cartons. Such marking means may be a laser marking means of the kind which marks by oblating the surfaces of the cartons, or may be a labelling machine such as indicated at 24 or an ink jet carton/case cooler. In this example a pair of laser printers are provided as indicated at 21, 22. However any other suitable kind of printer which is preferably able to print directly on the cartons as they are conveyed past the second printing station 20 by a second conveying means 8 which may be a continuation of the first conveying means 9 may be provided.

The printer or printers of the second marking means of whatever type, are all connected to the data bus 10.

Next the cartons of crisps or other packs are conveyed to the third III printing system part by a third conveying means 7 which may be a continuation of the second conveyer means 8, where the cartons are collected and placed on a pallet by a palletiser 30 which stacks the cartons appropriately. The palletiser 30 may include an integral or separate wrapping means 31 by which the collected packs on the pallet may be wrapped in a wrapping material such as plastic film, ready for distribution e.g. by transport such as a road vehicle.

The palletiser 30 is also connected to the data bus 10, and where a separate wrapping means 31 is provided, this too may be connected to the data bus.

At the third part III of the system, there is provided a third printing station 34 with a third marking means 33 including in this example a label printing and applying means so that as the packaged units (pallets) are conveyed past the third marking means 33 at the third printing station 34, a printed label is applied to the packaged unit, inside or outside the wrapping, which label may be printed immediately prior to application to the packaged units, or may be pre-printed.

The label printer may be a thermal transfer printer or any other suitable kind of printing means as required. In any event the third marking means is connected to the data bus 10.

The first, second and third conveying means 9, 8, 7 may also be connected to the data bus 10, as may the weigh station 11, check weight station 13 and metal detector 18 components.

It will be appreciated that at least some if not all of the components connected to the data bus 10 may emanate from alternative manufacturers, or even when from the same manufacturer may be of different generations or otherwise may be incompatible from a control point of view. This connected component may require command protocols particular to that component in order to perform a productive function such as "print" or "wrap".

In accordance with the invention a control means 40 which is also connected to the data bus 10 and includes for example a computer, issues data bus commands addressed to individual connected components appropriate to make the individual connected components perform productive functions, the control means 40 co-ordinating the packaging system to pack, mark, convey and collect as described, in response to a control algorithm.

Each individual connected component is connected to the data bus 10 via a connecting means which is indicated by the same reference numeral as the corresponding connected component in the drawing, but with an "a" suffix.

Each connecting means may be a serial connection which includes means to translate the data bus commands addressed to the associated connected component into a command protocol appropriate to control the individual connected component to operate to perform productive functions in accordance with the control algorithm.

In the case of custom made equipment for the system, the translation function of the connecting means may be performed by a control circuit within the connected component, but where the component is a standard component, the connecting means may include a translation means which recognises the data bus commands and translates them into a command protocol appropriate to the connected component.

Furthermore, connected components may send signals along the data bus 10 to the control means 40 via their connecting means. For example, the data bus 10 may be used to convey weight information from the weighing means 11. To the control means 40 so that the control means 40 controls the first and/or second and/or third marking means 12, 30, 33 to print information specific to the measured weight.

Any sensors or the like, for example which detect conveyor jams, marking means malfunctions, such as the exhaustion of label supply, may all send data to the control means 40 using the data bus 10.

Error signals etc. from the connected components may need translation into a protocol appropriate for transmission on the data bus 10, which may be achieved by the connecting means appropriate to the connected components.

The control means 40 may include a database of connected components to ensure that data bus commands appropriate to operational functionality of the connected components are sent to the connected components. For example the control means 40 may issue data bus commands appropriate to a label printing and applying marking means 33 to print and apply a label, and a data bus command appropriate to a laser printer to a laser printer 21, 22. However, even though the data bus commands may be product type or even manufacturer specific, data bus commands using a common computer protocol may be issued to all connected components, rather than command protocols using protocols or command language which are product type and/or manufacturer specific. Information about the connected component may be programmed into the control means 40, e.g. via an internet or intranet connection 44 from a remote database 45.

Information e.g. about the status of the packaging system may be provided to remote monitoring stations 50, 51, 52 via internet or intranet connections 46 too.

If desired in addition to the third marking means 33 an auxiliary label printer 60 may be provided at the third part III of the packaging system to enable labels to be printed under manual control, using data on the data bus 40, in the event that, for example, the labeller 33 fails to label a packaged unit correctly.

Various modifications may be made without departing from the scope of the invention.

For example where the invention has been described with reference to a crisp packaging system, the invention may be applied to any packaging system having three parts which require close control and co-ordination. Instead of weigh product station 11, check weight station 13 and metal detector station 18 and other kinds of components may be connected to the data base 40, to count size or otherwise analyse the articles, so that information dependent upon the analysis may be printed on the articles and/or their packs, and/or the packaging unit.

The data bus 40 may be virtual instead of physical with data bus commands being transmitted by radio, infra red, microwave or the like and being received by the connecting means of the components or by an associated receiver.

The invention claimed is:

1. A packaging system for packaging a plurality of individual articles into packs and for collecting together a plurality of packs into a packaged unit, the system including a first part where the individual articles are marked utilising a first marking means, a second part where the packs are marked utilising a second marking means, and a third part where the packaged unit is marked utilising a third marking means, and the first part including packing means for packing the articles into packs and first conveying means for moving the packs from the first part to the second part, and the second part including second conveying means for conveying the packs from the second to the third system part, and the third part including means to collect the plurality of packs into a packaging unit, wherein each of the first, second and third marking means, and the means for collecting the plurality of packs into a packaged unit are connected to a data bus by respective connecting means, there being a control means also connected to the data bus, the control means sending appropriately addressed data bus commands on the data bus to each of the connected components, the data bus commands all using a common computer protocol, and each of the connecting means of the connected components including means to translate data bus commands appropriate to that component into a command protocol which is read by the connected component which responds by performing a productive function, whereby the control means is able to control each of the connected components independent of command protocols recognised by the connected components.

2. A system according to claim 1 wherein at least one of the first and second conveying means is also connected to the data bus via connecting means which translate appropriately addressed data bus commands into command protocols to operate the conveyor(s).

3. A system according to claim 1 or claim 2 wherein each of the first, second and third marking means includes respectively at least one of a continuous ink jet printer, a laser printer, a thermal transfer printer and a label printer.

4. A system according to claim 1 wherein the first part of the packaging system includes means to weigh the articles so that information marked on the individual articles by the first marking means is dependent upon the weight analysis.

5. A system according to claim 1 wherein the first part of the packaging system includes means to size the articles so that information marked on the individual articles by the first marking means is dependent upon the size analysis.

6. A system according to claim 1 wherein the first part of the packaging system includes means to count elements so that information marked on the individual articles by the first marking means is dependent upon the count analysis.

7. A system according to claim 1 wherein the third part means to collect the plurality of packs into a packaging unit includes a palletiser whereby the packaged unit is a collection of packs on a pallet.

8. A system according to claim 7 wherein the palletiser includes means to wrap the collected articles in a wrapping and means to apply labels printed by the third marking means to the wrapping.

9. A system according to claim 1 wherein the data bus is provided by connection cable so that the connected components are all physically connected together.

10. A system according to claim 9 wherein the data bus includes an RS485 or RS422 or Ethernet standard cable.

11. A system according to claim 1 wherein the data bus is virtual, with each of the connected components receiving transmitted data bus commands and being adapted to respond to and translate data bus commands appropriate to that component into command protocols.

12. A system according to claim 1 wherein the control means issues data bus commands in one of HTTP, TPC/IP, IPX, FCP protocol.

13. A system according to claim 1 wherein the control means includes a database of connected components so that command protocols appropriate to the functionality of the connected components are issued.

* * * * *

UNITED STATES PATENT AND TRADEMARK OFFICE

CERTIFICATE OF CORRECTION

PATENT NO. : 7,461,495 B2
APPLICATION NO. : 09/728395
DATED : December 9, 2008
INVENTOR(S) : Paul Mills It is certified that error appears in the above-identified patent and that said Letters Patent is hereby corrected as shown below:

| Column | Line | |
|---|---|---|
| 6 | 56 | In Claim 12, delete "TPC/IP," and insert -- TCP/IP, --, therefor. |

Signed and Sealed this

Seventeenth Day of February, 2009

JOHN DOLL
*Acting Director of the United States Patent and Trademark Office*